United States Patent [19]

Leflet

[11] Patent Number: 4,860,474

[45] Date of Patent: Aug. 29, 1989

[54] SINGLE-POSITION SIGNAL DEVICE

[76] Inventor: David Leflet, 8610 NW. 178th St., Miami, Fla. 33015

[21] Appl. No.: 182,484

[22] Filed: Apr. 15, 1988

[51] Int. Cl.[4] ..... G09F 19/00

[52] U.S. Cl. ..... 40/530; 40/359

[58] Field of Search ..... 40/359, 486, 488, 492, 40/497, 501, 535, 530, 649; 232/34, 35, 37; 116/306, 309, 311, 313, 315, 319

[56] References Cited

U.S. PATENT DOCUMENTS 1,250,543 12/1917 Bartolomeo ..... 40/486
3,002,491 10/1961 Bachman ..... 116/319
3,219,009 11/1965 Olsen ..... 40/535
3,916,547 11/1975 Ryder ..... 40/657

*Primary Examiner*—Robert P. Swiatek
*Assistant Examiner*—Cary E. Stone

[57] ABSTRACT

A single-position signal device comprising a base plate adapted to be attached to a primary object, such as an office file, and a signal panel having obverse and reverse display sides mounted in a single signaling position against the base plate which can be releasably held in the signaling position while displaying one of the display sides, and can be reversed to display the other of the display sides.

18 Claims, 3 Drawing Sheets

SINGLE-POSITION SIGNAL DEVICE

BACKGROUND OF THE INVENTION

1. FIELD OF THE INVENTION

This invention relates to a novel single-position signal device which is adapted to be attached to a primary object such as an office file, an item of manufacture, a pill bottle, or like items. It may be used to indicate the status of an office file, open or closed; the status of a manufactured item, complete or incomplete; or attached to a pill bottle to indicate the number of pills taken within a given period of time. It can be used to indicate the status of many different items by such words as yes/no, opened/closed, in/out, on/off, stop/go, and for sale/sold. As it may be seen, there are an infinite number of signaling uses for the present invention. In addition to words; letters, numbers, symbols or color codes such as red/green can also be used to indicate status change.

2. DESCRIPTION OF THE PRIOR ART

There are many kinds of signals that may be used on the records in a business office. For example, there are colored tags that may be adhered to the margins of office files to indicate the category of each file. Also, there are colored metal flags, which can be clipped onto file cards, for indicating the status or category of the information on each card. These prior signal devices must constantly be moved or replaced and/or changed to keep them up to date. For example, if a response is due, a red label or flag may be attached. If the response has been sent, the label or flag may have to be changed to or replaced by a different green label or flag. Similarly, a green label or flag may indicate that an item is "for sale" or "inventoried" and must be changed to or replaced by a red label or flag to indicate that the item has been sold or has not been inventoried. Such changes and/or replacements are done manually and can be very tedious and time consuming.

There are also large signs, such as are described in U.S. Pat. Nos. 1,653,325 to E. Watts; 2,501,044 to S. J. Gianelloni, Jr.; 4,318,238 to A. J. Macarle, Jr.; and 4,597,209 to M. E. Hukill, which are signal devices used to indicate the status or category of a situation. Such signs may have two or more positions to indicate different information to a viewer. These signs may be mounted on a building, or on a heavy standard for placing in a roadway. Such signs are heavy and bulky and completely impractical for use in a home or business office environment, especially with respect to office records and the like.

The two-position signal device described in my patent application, Ser. No. 165,976 filed Mar. 9, 1988, avoids the foregoing undesirable characteristics by providing a convenient, low-cost device for reminding one of the status of a primary object. That prior device can be easily attached to the primary object and can be changed with the flip of a finger without removing the device from the object. That prior two-position device is small, light in weight, low in cost, convenient to use, and can be made entirely of a synthetic plastic material. Nevertheless, it is desirable to provide alternative devices which have the foregoing characteristics, but which are different in design and may be better adapted to some specific uses than the two-position device.

OBJECTS OF THE INVENTION

An object of this invention is to provide a novel single-position signal device adapted for use with a primary object such as an office file, an item of manufacture, a pill bottle, or the like. The novel device provides a convenient and easy way to remind one of the status of a file, project, or situation; or to advise others of the same information.

Another object is to provide a signal device that can be attached to a primary object and can be changed from one status condition to another using a single signal position, with simple manipulation with one's fingers.

A further object is to provide a novel single-position signal device that is small, light in weight, low in cost, and convenient to use.

Still another object is to provide a novel single-position signal device that can be made entirely of a synthetic plastic material and can be adhered to a primary object, such as an office file, with an adhesive, by a VELCRO fastener or by a pin, clip or staple.

SUMMARY OF THE INVENTION

The novel signal device comprises a base plate adapted to be attached to a primary object, such as an office file, a signal panel having an obverse display side and a reverse display side pivotally mounted in a single signaling position against the base plate, means for releasably holding the signal panel in said single signaling position and displaying one of said display sides, means for reversing said signal panel in said single signaling position to display the other of said display sides, and means, such as a pressure-sensitive adhesive on the back of the base plate, for attaching the base plate to an office file or other primary object. In one form, the signal panel has a proximal edge and an opposite distal edge, and a pivotal mounting connects the proixmal edge to the base plate at one end of the signaling position. Thereby, the signal panel can be rotated about the pivotal mounting out of the single signaling position.

In one arrangement, the reversing means includes a signal panel consisting essentially of a pivot-mounting portion pivotally connected to the base plate at one end of the signaling position, a physically-separate display portion having said obverse and reverse display sides, and a centrally-located reversing dowel connecting said pivot-mounting portion and said display portion in abutting relation. When the signal panel is rotated out of the signaling position, the display portion can be turned around the reversing dowel and then the signal panel can be repositioned in the signaling position with the selected one of the display sides on display.

In another arrangement, the reversing means includes a pivotal mounting comprising a hinge pin extending sidewardly from each side of the proximal end of the signal panel, a first pair of journals for each end of the hinge pin at one end of the signaling position, a second pair of journals for each end of the hinge pin at the other end of the signaling position, and a pair of guidance slots for guiding the hinge pin ends between the first pair of journals and the second pair of journals. When the signal panel is rotated out of the signaling position, the hinge pins ends can be slid in the guidance slots to one or the other of the pairs of journals, and then the signal panel can be repositioned in the signaling position with the selected one of the panel display sides on display.

In a preferred embodiment, the base plate has two flanges upstanding from opposite edges of the base plate. The signal panel is pivotally mounted along the proximal side thereof to the centers of the two flanges against the base plate in the signaling position. The flanges and edges of the panel have mating bumps and detents for releasably holding the panel in each of the two extreme positions. Also, the panel in its signaling position, extends beyond the base plate, so that it can easily be engaged manually and flipped out of the signaling position.

DETAILED DESCRIPTION OF THE INVENTION INCLUDING THE PREFERRED EMBODIMENT

Figure 1:
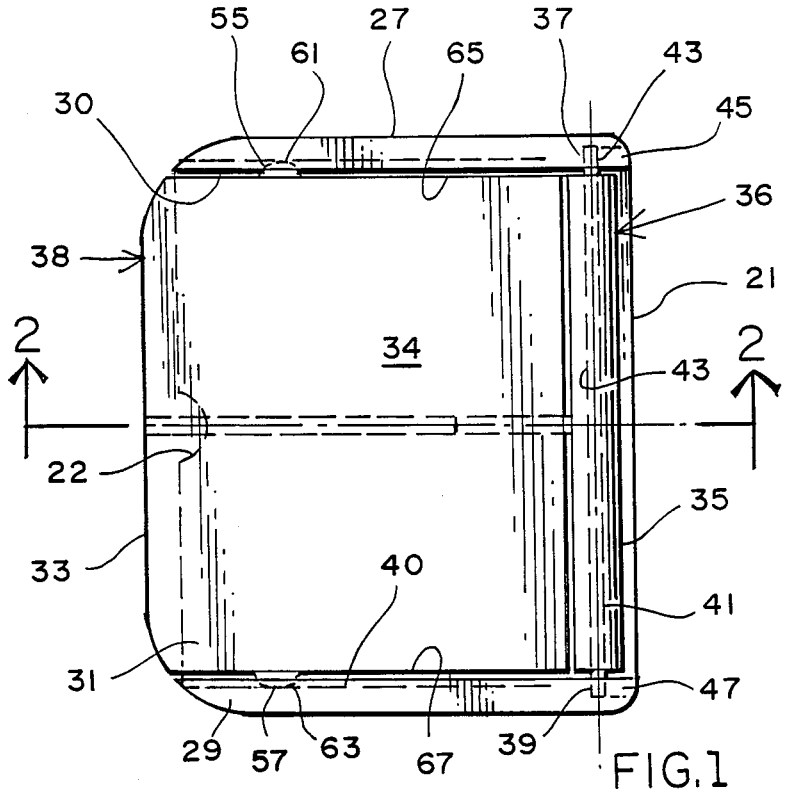
FIG. 1 is an elevational view of a first preferred embodiment of the novel device.

The following description of some of the preferred embodiments of the concepts of this invention is made in reference to the accompanying figures. Where an individual structural element is depicted in more that one figure, it is assigned a common reference numeral for simplification of identification and understanding.

Figure 3:
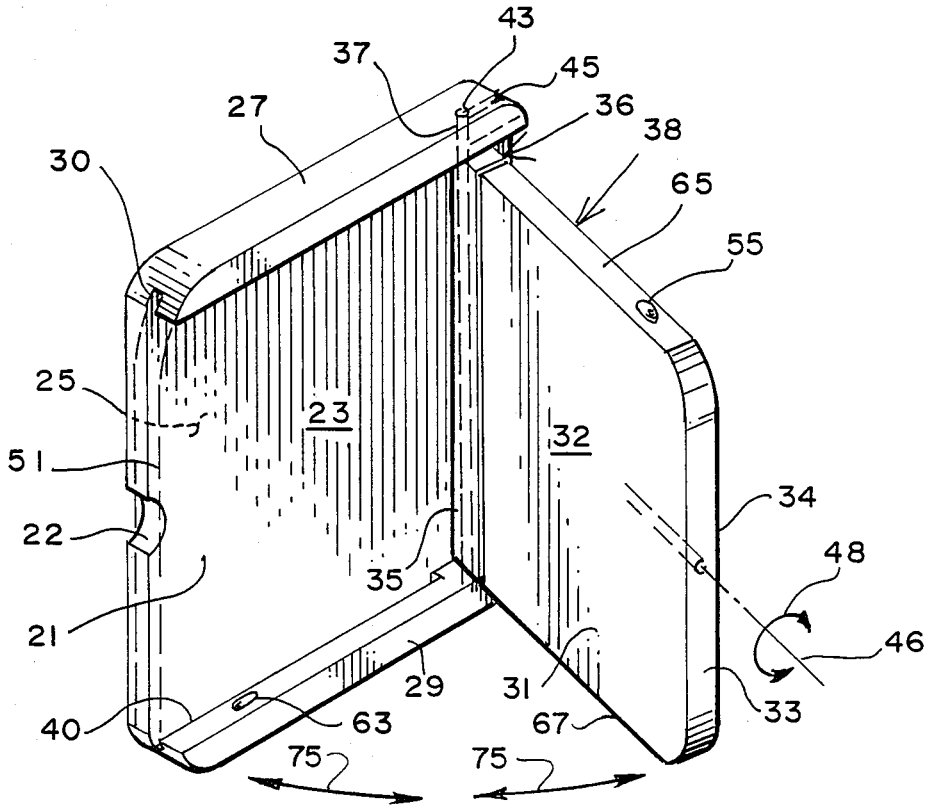
FIG. 3 is a perspective view of the first preferred embodiment with the signal panel rotated out of the signaling position.
Figure 2:
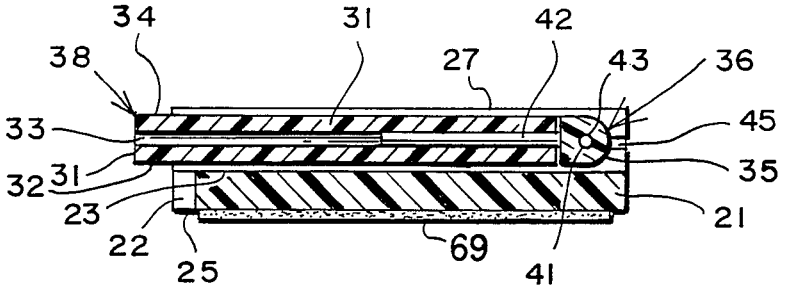
FIG. 2 is a sectional view of the first preferred embodiment viewed along section line 2—2 of FIG. 1.

A first preferred embodiment of the novel device shown in FIGS. 1 to 4 comprises a substantially rectangular base plate 21 having rounded corners, a major front surface 23 and an opposite major back surface 25 (FIGS. 2 and 3). An upper flange 27 is upstanding along the upper edge of the front surface 23 and a lower flange 29 is upstanding along the lower edge of the front surface 23, both flanges 27 and 29 are integral with the base plate 21 and face one another. The upper flange 27 contains a first base slot 30 which is adjacent to the front surface 23, and the lower flange 29 contains a second base slot 40 which is also adjacent to the front surface 23. The slots 30 and 40 are not continuous throughout the flanges 27 and 29 but rather terminate adjacent the proximal edge 35 of the signal panel 31.

A signal panel 31 is pivotally mounted to the upper and lower flanges 27 and 29. The signal panel 31 is generally rectangular and has a height such that it fits loosely between the upper and lower flanges 27 and 29. The width of the signal panel 31 extends between a distal edge 33 and a proximal edge 35 which houses the pivotal mounting. The signal panel 31 has an obverse side 32 and a reverse side 34 denoting each display area of the signal panel 31.

The pivotal mounting for the signal panel 31 includes an upper flange aperture 37 centrally located in the upper flange 27, a lower flange aperture 39 centrally located in the lower flange 29, and a signal panel aperture 41 through the signal panel 31 parallel to and close to the proximal edge 35. A hinge pin 43, which may be of metal, but is preferably plastic, extends into the upper aperture 37, through the panel aperture 41 and into the lower aperture 39. The flanges 27 and 29 have upper and lower hinge pin slots 45 and 47 respectively, which are slightly smaller than and connect with the flange apertures 37 and 39, and which permit the hinge pin 43 assembled in the signal panel 31 to be slid into and out of the hinge pin apertures 43 and 45, respectively. The signal panel 31 can rotate around the hinge pin 43 into and out of a signaling position 51 (shown with phantom lines 75 in FIG. 3). In the signaling position 51, the signal panel 31 is adjacent the front surface 23 of the base plate 21 and is also between the upper and lower flanges 27 and 29.

The proximal end 35 of the signal panel 31 is rounded, as shown if FIG. 2, to increase the clearance between the base plate 21 and the proximal end 35 of the signal panel 31. Also, the width of the signal panel 31 is such that the distal edge 33 of the signal panel 31 extends beyond the edges of the base plate 21 when the signal panel 31 is in its signaling position 51. This permits the user to engage the distal end 33 easily with a finger and to flip the signal panel 31 in and out of the signaling position. The edge of the base plate 21 adjacent the distal edge 33 of the signal panel 31 has a finger scallop 22 about equidistant from the flanges 27 and 29.

The novel device also has means for releasably holding the signal panel 31 in the signaling position 51 between the upper and lower flanges 27 and 29. The releasable holding means may be mating pairs of a bump and a detent. As shown in FIGS. 1 and 3, the signal panel 31 has an upper bump 55 on its upper intermediate edge 65 and a lower bump 57 on its lower intermediate edge 67. There are mating upper and lower detents 61 and 63 in the facing sides of the upper and lower flanges 27 and 29 respectively for mating with the upper and lower bumps 55 and 57 when the signal panel 31 in the signaling position 51, as shown in FIG. 1.

Figure 4:
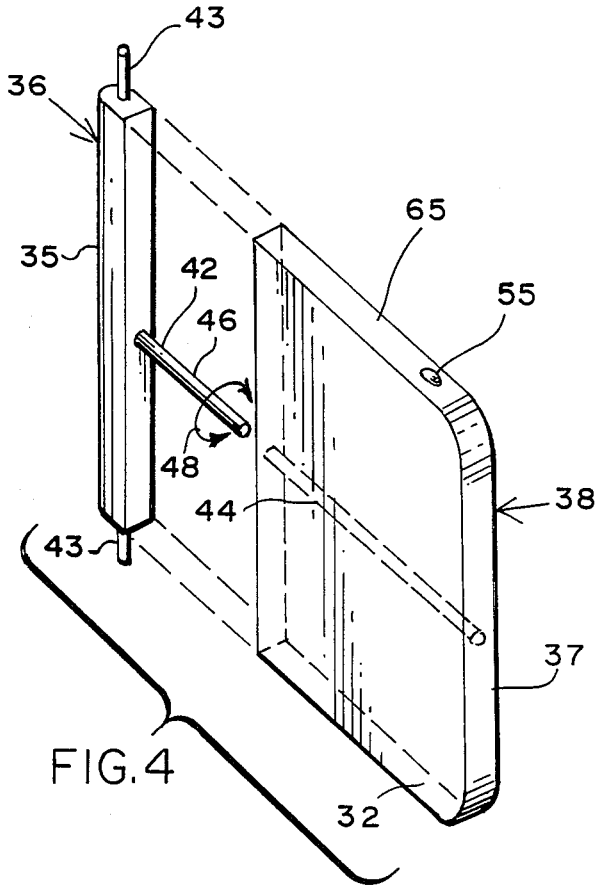
FIG. 4 is a perspective view of the two portions of signal panel shown in FIG. 3.

The signal panel 31 consists essentially of a pivot-mounting portion 36, a physically-separate display portion 38 and a centrally-located reversing dowel 42 connecting the pivot-mounting portion 36 and the display portion 38 in abutting relationship, as shown in the separated perspective view in FIG. 4. The pivot-mounting portion includes the proximal edge 35 of the signal panel 31, the hinge pin 43 and the reversing dowel 42. The display sides 32 and 34 and a cylindrical aperture 44 for receiving the dowel 42 (FIG. 4).

The display portion 38, when assembled with the pivot-mounting portion 36, is free to rotate on the dowel 42 into two different positions aligned with the pivot-mounting portion 36 on an axle 46 as shown by the arrow 48. After the signal panel 31 can be rotated out of the signaling position 51, as shown in FIG. 3, the signal portion 38 can be given a half turn on the dowel 42, and then the signal panel 31 returned to the signaling position 51, in order to change the display between the obverse and reverse display sides 32 and 34. This cycle can be repeated as many times as desired.

The novel device also has a means for attaching the base plate 21 to the surface of a primary object, such as an office file, a file folder, a pill bottle, an item of manufacture, or of a similar article for which similar alternate information is desired. As shown in FIG. 2, the back surface 25 of the base plate 21 carries a layer 69 of a pressure-sensitive adhesive. Other types of adhesive can be used instead. Also, the base plate 21 can include a VELCRO fastener, a clip, a pin or a staple instead of an adhesive, for attaching the novel device.

The base plate 21 and the signal panel 31 are each made of a relatively rigid plastic material by any of the methods used for fabricating small items. The base plate 21 of the first preferred embodiment is about 25 mm wide, 25 mm high and 2.5 mm thick. The flanges 27 and 29 are each about 2.5 mm high and stand out about 3.0 mm from the front surface 23. The signal panel 31 is about 20 mm high, about 30 mm wide and 2.5 mm thick. Of course, the novel device can be made in other dimensions and other proportions. Also, the base plate 21 may be flexible enough to conform to and attach to primary objects which have curved surfaces.

The obverse and reverse display sides 32 and 34 of the signal panel 31 have different contrasting colors such as red and green respectively, and/or may carry different letters, numbers or symbols, to indicate two different conditions or statuses as described above. In use, the novel device is attached to the item of interest and the signal panel is flipped to a position so that the device indicates the desired condition or status. When the condition or status of the primary object changes, the signal panel is flipped out of the signaling position, the signal portion reversed and the panel returned to the signaling position to indicate the change. The reversal of the display sides of the panel is accomplished without removing the device from the primary object and can be accomplished with little effort and a minimum of time. The color fields, letters, numbers and/or symbols may be carried directly on the display surfaces mentioned, or the surfaces mentioned may carry transparent pockets into which the desired information can be inserted and removed. Also, the surfaces mentioned can be adapted to receive a graphic notation applied by the user.

Figure 5:
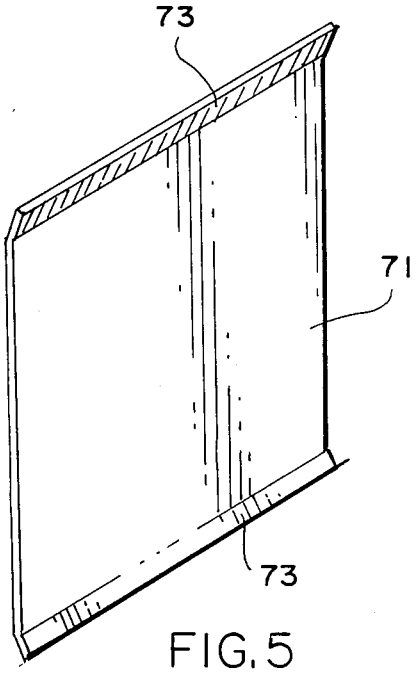
FIG. 5 is a perspective view of a frame that may be inserted in the flange grooves of the first embodiment.

A card carrying additional information may be inserted in or wedged in the first and second base slots 30 and 40. FIG. 5 is a perspective view of a preferred card 71 having narrow bent margins 73 along the edges which fit in the base slots 30 and 40. The additional information can be viewed when the display panel is rotated out of signaling position. It may be used, for example, to give a reminder or warning of something to do, or not to do, when a status change occurs.

Figure 7:
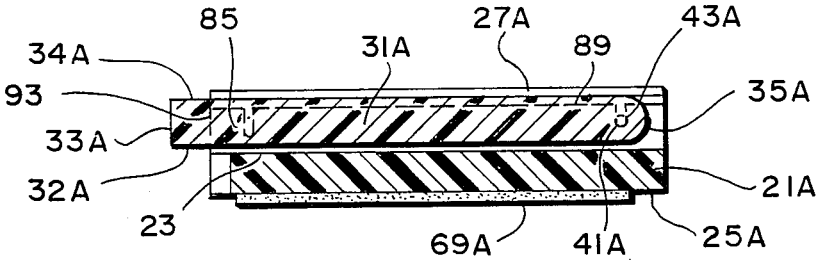
FIG. 7 is a sectional view of the second preferred embodiment view along section line 7—7 of FIG. 6.
Figure 6:
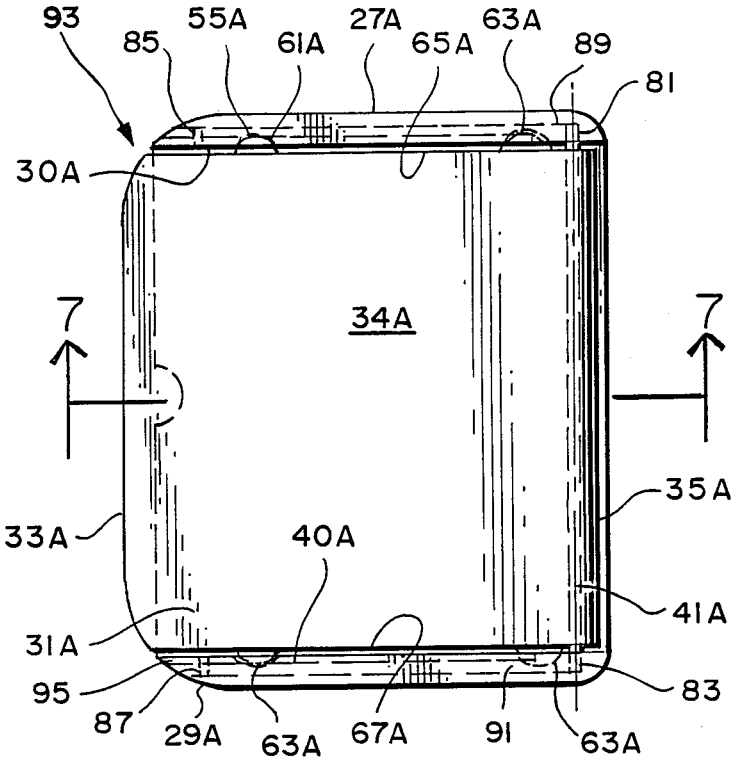
FIG. 6 is an elevational view of a second preferred embodiment of the novel device.
Figure 8:
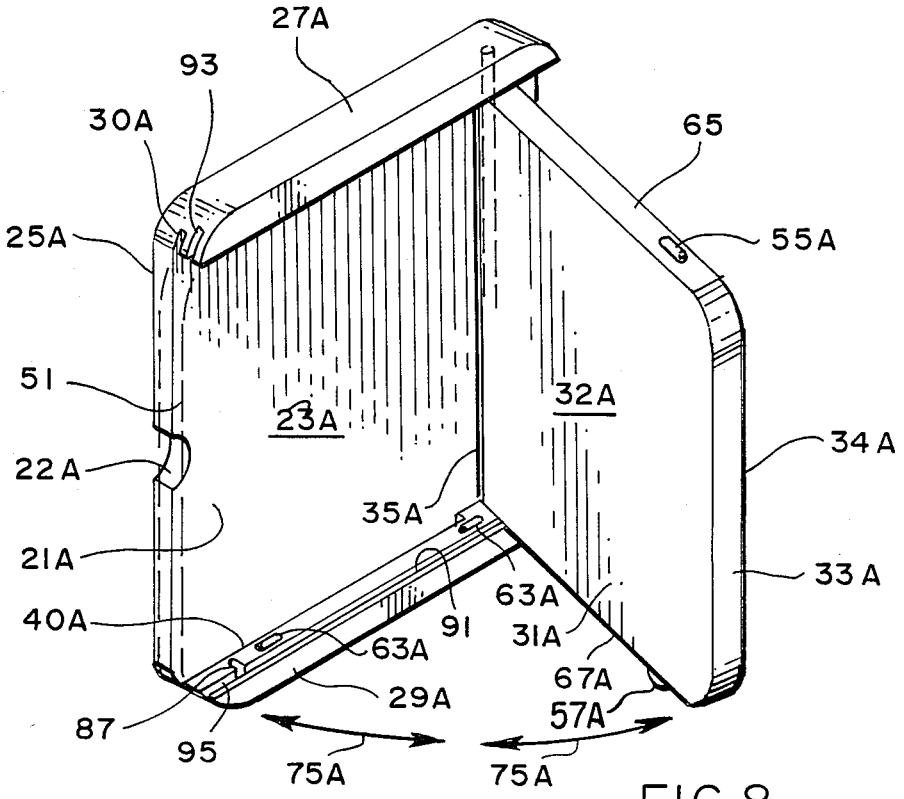
FIG. 8 is a perspective view of the second preferred embodiment with the signal panel rotated out of the signaling position.

The second preferred embodiment of the novel device shown in FIGS. 6 to 8 is similar in construction to that of the first embodiment, except for the means for reversing the display side of the signal panel. Similar structures carry the same reference numerals followed by an "A," and have the same function as described above for the first embodiment.

The second embodiment comprises a substantially rectangular base plate 21A having rounded corners, a major front surface 23A and an opposite back surface 25A. An upper flange 27A and a lower flange 29A are upstanding along the upper and lower edges respectively of the front surface 23A. Both flanges 27A and 29A are integral with the base plate 21A and face one another. The upper flange 27A has a first base slot 30A adjacent the front surface 23A and the lower flange 29A has a second base slot 40A adjacent the front surface 23A, as in the first embodiment.

A signal panel 31A is pivotally mounted to the upper and lower flanges 27A and 29A. The signal panel 31A has the same or a similar design as the signal panel 31 in the first embodiment, except that it is in one piece and does not have a dowel. Briefly, the signal panel 31A is generally rectangular, has a height that fits loosely between the upper and lower flanges 27A and 29A, and a width that extends between a distal end 33A and a proximal end 35A which houses the pivotal mounting. The signal panel 31A has an obverse side 32A and a reverse side 34A.

The pivotal mounting includes a hinge pin 43A through a panel aperture 41A end extending outwardly from the sides of the signal panel 31A near the proximal edge 35A thereof. There is a first pair of upper and lower right journals 81 and 83 at the right-hand ends of the flanges 27A and 29A (as viewed in FIGS. 6 to 8), and a second pair of upper and lower left journals 85 and 87 at the left-hand ends of the flanges 27A and 29A. The upper flange 27A has an upper guidance slot 89 in its side that faces the lower flange 29A, and that connects the upper first and second journals 81 and 85. The lower flange 29A has an opposite lower guidance slot 91 in its side that faces the upper flange 27A, and that connects the lower first and Second journals 83 and 87. There are upper and lower removal slots 93 and 95 which are extensions of the guidance slots 89 and 91. The journals 81, 83, 85, and 87 are slightly larger than the sides of the hinge pin 43A, so that the hinge pin 43A fits loosely in each pair of journals. The guidance slots 89 and 91 and removal slots 93 and 95 are slightly smaller than the ends of the hinge pin 43A, so that the hinge pin 43A must be pressed with some force to pass therethrough. The combination of hinge pin 43A, journals 81, 83, 85 and 87 and guidance slots 91 and 93 comprise the reversing means for the second embodiment.

The second embodiment is assembled by pressing the hinge pin 43 into the panel aperture 41A so that the ends thereof extend outwardly. The hinge pin ends are then pressed into the removal slots 93 and 95 until they slip into the left pair of journals 85 and 87. In this position, the signal panel 31A can be rotated to the signaling position against the front surface 23A of the base plate 21A, thereby displaying the obverse side 32A. When a reversal of the signal panel 31A is desired, the signal panel 31A is rotated out of the signaling position, the hinge pin ends are pressed through the guidance slots 89 and 91 until they slip into the right pair of journals 81 and 83, as shown in FIG. 8. The signal panel 31A can be rotated into the signaling position against the front surface, thereby displaying the reverse side 34A of the signal panel 31A. The signal panel 31A can be reversed as many times and as often as desired. It is noteworthy that any alphanumeric inscription on the display sides of the second embodiment are upside-up with respect to one another whereas, in the first embodiment, they are upside-down with respect to one another. By combining the embodiments above described, a single position signal panel is capable of bearing four variants of alphanumeric or symbolic inscription.

As in the first embodiment, the proximal end 35A is rounded to increase the clearance opposite the front surface 23A, and the width of the signal panel 31A is such that the distal end 33A extends beyond the edges of the base plate 21A when the signal panel 31A is in the signaling position. There are mating pairs of bumps 55A and 57A and detents 61A and 63A in the facing sides of the signal panel 31A and the upper and lower flanges 27A and 29A for releasably holding the signal panel 31A in its signaling position. The back surface 25A of the base plate 21A carries a layer 69A of a pressure-sensitive adhesive for attaching the device to a primary object (FIG. 7). Other types of adhesive and other types of attachment can be substituted.

The second embodiment may be made of the same materials and may be made in the same size range as the first embodiment described above. The information displayed on the obverse and reverse sides 32A and 34A also may be the same as or similar to the information displayed in the first embodiment.

The foregoing figures and descriptions thereof are provided as illustrative of some of the preferred embodiments of the concepts of this invention. While these embodiments represent what is regarded as the best modes for practicing this invention, they are not intended as delineating the scope of the invention, which is set forth in the following claims.

What is claimed is:

1. A signal device for use with a primary object, such as an office file or the like, said device comprising:

a base plate adapted to be attached to a primary object;

a signal panel having an obverse display side and a reverse display side mounted in a single signaling position against said base plate wherein said signal panel has a proximal edge and an opposite distal edge, and said device includes a pivotal mounting connecting said proximal edge of said signal panel to said base plate at one end of said signal panel, whereby said signal panel can be rotated about said pivoted mounting out of said single signaling position;

means for releasably holding said signal panel in said single signaling position and displaying one of said display sides;

means for reversing said signal panel into said single signaling position to display the other of said display sides of said signal panel; and means for attaching said base plate to said primary object.

2. The signal device defined in claim 1 wherein said reversing means includes said signal panel consisting essentially of a pivot-mounting portion pivotally connected to said base plate at said one end of said signal panel, a physically-separate display portion having said obverse and reverse sides, and a centrally-located reversing dowel connecting said pivot-mounting portion and said display portion in abutting relation whereby, when said signal panel is rotated out of said signaling position, said display portion can be turned around said reversing dowel and said signal panel can be repositioned in said signaling position with a selected one of said obverse and reverse display sides of said signal panel displayed.

3. The signal device defined in claim 1 wherein said reversing means includes a pivotal mounting comprising a hinge pin extending sidewardly from each side of the proximal edge of said signal panel, a first pair of journals for each end of said hinge pin in said base plate at said one end of said signal panel, a second pair of journals for each end of said hinge pin in said base plate at the other end of said signaling position, and a pair of guidance slots for guiding said hinge pin ends between said first pair of journals and said second pair of journals whereby, when said signal panel is rotated out of said signaling position, said hinge pin ends can be slid in said slots from one pair of said journals to the other pair of journals and said signal panel can be repositioned in said signaling position with a selected one of said obverse and reverse display sides of said signal panel displayed.

4. The signal device defined in claim 1 wherein said base plate and said signal panel are each constituted of a relatively rigid plastic.

5. The signal device defined in claim 1 wherein said obverse and reverse sides of said signal panel have different contrasting information thereon.

6. The signal panel defined in claim 1 wherein said attaching means is an adhesive layer on a surface of said base plate.

7. The signal panel defined in claim 1 wherein said base plate includes two substantially parallel flanges upstanding from one surface thereof, and said signal panel is pivotally mounted between said flanges.

8. The signal panel defined in claim 7 wherein said proximal edge of said signal panel is rounded to allow improved clearance when said signal panel is rotated out of said signaling position.

9. The signal panel defined in claim 7 wherein there are confronting surfaces between said signal panel and each of said flanges and said releasable holding means comprises a bump on at least one of said confronting surfaces and a mating detent in the other of said confronting surfaces.

10. A signal device adapted for use with a primary object such as an office file or the like, said device comprising, a generally rectangular planar base plate having two major opposed surfaces and a pair of spaced flanges upstanding from, and integral with opposite edges of one of said major surfaces;

a generally-rectangular signal panel having an obverse and a reverse side, said signal panel being pivotally mounted in a single signaling position between said upstanding flanges and displaying one of said obverse and reverse sides wherein said signal panel has a proximal edge and an opposite distal edge, and said device includes a pivotal mounting connecting said proximal edge of said signal panel to said flanges of said base plate at one end of said signal panel, whereby said signal panel can be rotated about said pivotal mounting out of and into said single signaling position;

means for releasably holding said signal panel in said single signaling position with one of its displayed sides;

means for reversing said signal panel into said single signaling position to display the other of said obverse sides of said signal panel; and means for attaching said base plate to said primary object.

11. The signal device defined in claim 10 wherein said reversing means includes said signal panel consisting essentially of a pivot-mounting portion at the proximal end thereof and pivotally connected to said base plate at said one end of said signal panel, a physically-separate display portion having said obverse and reverse sides, and a centrally-located reversing dowel rotatably connecting said pivot-mounting portion with said display portion in abutting relation whereby, when said signal panel is rotated out of said signaling position, said display portion can be reversed around said dowel and said reversed signal panel can be repositioned in said signaling position to display the other of said sides of said display portion.

12. The signal device defined in claim 10 wherein said reversing means includes a pivotal mounting comprising a hinge pin extending from each side of the proximal edge of said signal panel, a first pair of journals for each end of said hinge pin, said first journals being located in facing positions in the sides of said flanges at one end of said signal panel, a second pair of journals for each end of said hinge pin, said second journals being located in facing positions in the sides of said flanges at the other end of said signal panel, and a pair of guidance slots located in facing positions in the sides of said flanges, each slot connecting a first journal with a second journals whereby, when said signal panel is rotated out of said signaling position on said hinge pin, said ends of said hinge pin can be slid in said slots from one pair of said journals to said other pair of said journals and said signal panel can be repositioned in said single signaling position with the other of its sides displayed.

13. The device defined in claim 10 wherein the distal edge of said signal panel extends beyond said base plate when it is in said signaling position, thereby permitting easier digital engagement with said distal edge.

14. The device defined in claim 10 wherein the intermediate edges of said signal panel between said proximal edge and said distal edge lie close to said flanges in said signal position, and said releasable holding means comprises mating bumps and detents in said flanges and said intermediate edges.

15. The device defined in claim 14 wherein said bumps extend outward from said intermediate edges into mating detents in said flanges when said signal panel is in said signaling position.

16. The device defined in claim 15 wherein said flanges contain grooves capable of accepting a card member and adjacent to said one of said major surfaces of said base plate and terminating opposite the proximal edge of said signal panel.

17. The device defined in claim 10 wherein said proximal edge of said signal panel is rounded to increase the clearance between said proximal edge and said base plate when said signal panel is rotated on said pivotal mounting.

18. The signal device defined in claim 10 wherein said attaching means includes a layer of pressure-sensitive adhesive coated on the other of said major surfaces.

* * * * *